United States Patent [19]

Kratz et al.

[11] 4,032,872

[45] June 28, 1977

[54] BEAM ADJUSTMENT ASSEMBLY FOR A CATHODE RAY TUBE

[75] Inventors: Jerrold Kerwin Kratz; Edward Walter Christensen, II, both of Indianapolis, Ind.

[73] Assignee: RCA Corporation, New York, N.Y.

[22] Filed: Oct. 21, 1975

[21] Appl. No.: 624,634

[52] U.S. Cl. ..... 335/212; 335/210

[51] Int. Cl.[2] ..... H01F 7/00

[58] Field of Search ..... 335/212, 213, 210; 178/7.8, 7.81

[56] References Cited

UNITED STATES PATENTS

| | | | |
|---|---|---|---|
| 2,972,074 | 2/1961 | Vasilevskis | 335/212 |
| 3,305,744 | 2/1967 | Werst | 335/212 |
| 3,332,046 | 7/1967 | Melone | 335/212 |

*Primary Examiner*—Harold Broome

*Attorney, Agent, or Firm*—Eugene M. Whitacre; Paul J. Rasmussen

[57] ABSTRACT

A nonmagnetic supporting member is adapted to surround a picture tube neck portion and includes a first collar having a plurality of circumferentially spaced cam-receiving apertures and a captivating collar spaced from the first collar, the supporting member including a clamp arrangement for fixedly mounting the member to the tube neck. A plurality of rotatable magnetized rings are mounted adjacent to the captivating collar and a rotatable second collar is mounted between the magnetized rings and the first collar. The second collar includes a plurality of ramp portions which, when rotated by tabs located on the first and second collars to locate the ramps within the apertures, unlocks the magnetized rings to enable adjustment. A second set of tabs formed on the first and second collars permit rotation of the ramp portions out of the apertures which increases the pressure on the magnetized rings between the captivating and first collars for effectively locking the rings in position.

6 Claims, 7 Drawing Figures

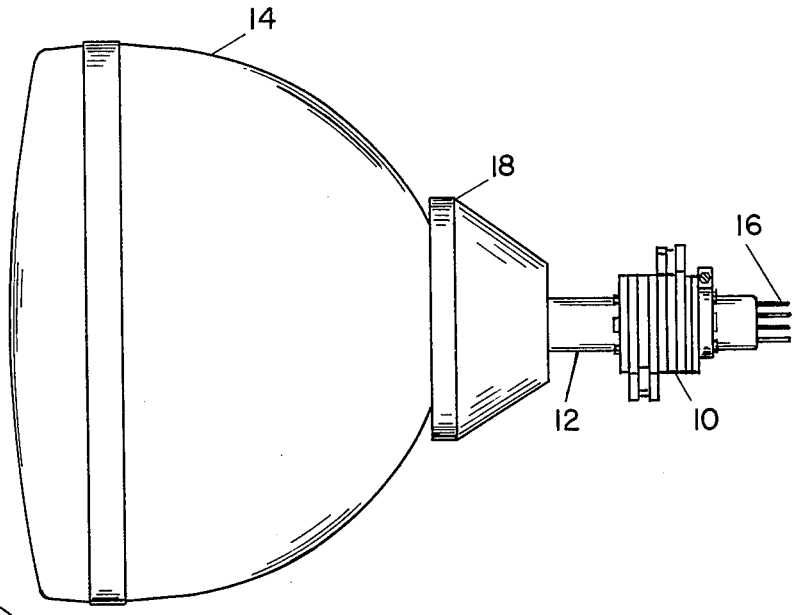
FIG. 1
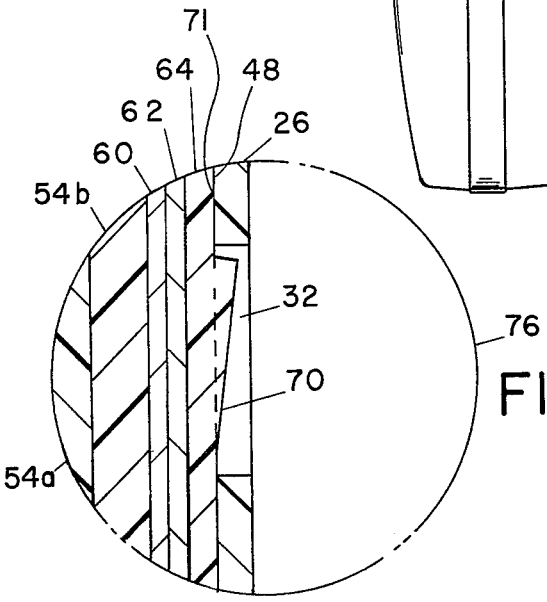
FIG. 2C
FIG. 2B
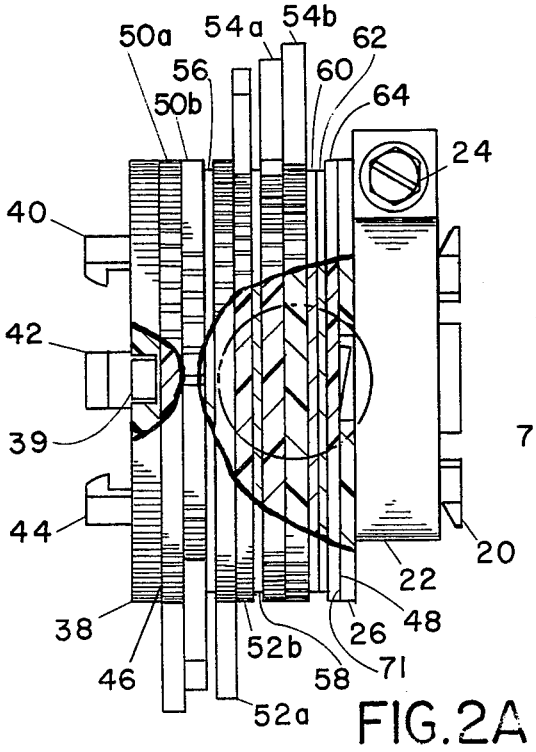
FIG. 2A
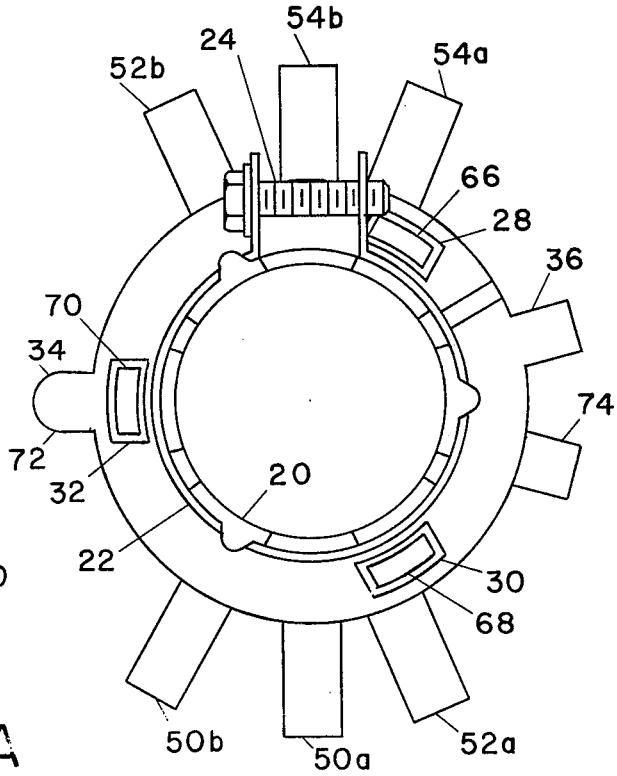

BEAM ADJUSTMENT ASSEMBLY FOR A CATHODE RAY TUBE

BACKGROUND OF THE INVENTION

This invention relates to a beam adjustment assembly for a cathode ray tube.

Television receivers employing an in-line color television picture tube without internal pole pieces utilize a plurality of pairs of multi-pole magnetic rings mounted concentric with the neck of the picture tube in proximity with the electron gun to provide for an adjustment of the relative beam landings of the three electron beam produced by the electron gun to effect static convergence of the beams at the central portion of the picture viewing screen. These pairs of rings are generally mounted on a cylindrical nonmagnetic sleeve clamped to the neck of the picture tube thereby providing for axial rotation of the rings with respect to the neck of the picture tube. Upon having achieved a proper adjustment of the rings with respect to the neck of the picture tube, various techniques have been employed to provide for locking of these rings in their optimum location. One technique employed utilizes an adhesive which bonds the various rings, one to the other, and to the cylindrical sleeve clamped to the neck of the picture tube. Another technique employs a threaded collar which is screwed onto the cylindrical sleeve and provides for the application of sufficient pressure between the various rings and against a collar which is part of the sleeve clamped to the neck of the picture tube. Still another technique utilizes a second collar which snaps onto the cylindrical tube, and a third collar which is rotatably mounted with respect to the first collar in a manner which will provide for clamping of the rings with respect to the cylindrical sleeve when the third collar is rotated to a predetermined position relative to the first collar. Each of these techniques require the application of a rotationl force applied to the magnet assembly and relative to the neck of the picture tube, which force may cause the magnets to be undesirably moved with respect to the neck of the picture tube during the locking procedure.

SUMMARY OF THE INVENTION

A beam adjustment assembly for a cathode ray tube comprises supporting means including a nonmagnetic supporting member having a central aperture for receiving the neck of the tube and a first resilient nonmagnetic collar including a first camming means and first and second tabs and being in a plane substantially perpendicular to the neck of the tube and including captivating means for providing a surface substantially parallel to the first collar and substantially a first distance therefrom. Clamping means positioned on the supporting member enables the prevention of movement of the supporting member relative to the tube. Means positioned adjacent the supporting member and between the first collar and the captivating means and having a central aperture therein for receiving the neck of the tube for providing a plurality of magnetic regions adjacent the central aperture thereof to produce magnetic fields in the central aperture. A third non-magnetic collar having a central aperture therein for receiving the neck of the tube has a second camming means and third and fourth tabs and is positioned between the first collar and the means positioned adjacent the supporting member and in a plane parallel with the first collar. The second camming means of the third collar operating in conjunction with the first camming means of the first collar enables the captivating means and the third collar to provide first forces on the means positioned adjacent the supporting member when the first and third tabs are rotatably aligned and second forces on the means positioned adjacent the supporting member when the second and fourth tabs are rotatably aligned thereby providing for control of the degree of restraint of movement of the means positioned adjacent the supporting member relative to the supporting member by alternately applying forces to the first and third tabs and between the second and fourth tabs.

A more detailed description of the invention will be given in the following specification and accompanying drawings, in which:

FIG. 1 is a diagrammatic side view of one embodiment of a beam adjustment assembly, including magnetic rings, according to the invention mounted on an in-line beam color television picture tube;

FIG. 2A is a side view of the beam adjustment assembly illustrated in FIG. 1 with the locking mechanism unlocked, thereby allowing for adjustment of the magnetic rings;

FIG. 2B is an end view of the beam adjustment assembly of FIG. 1 with the locking mechanism unlocked;

FIG. 2C is an expanded view of a portion of FIG. 2A;

DESCRIPTION OF THE INVENTION

Figure 3A:
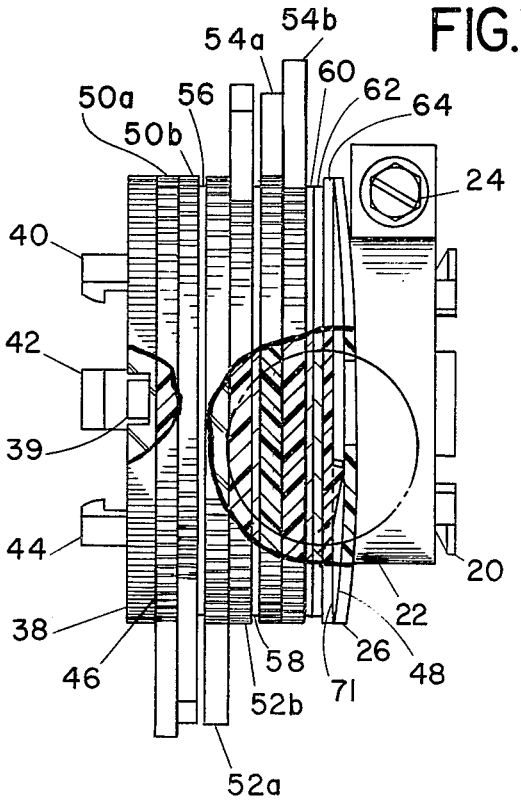
FIG. 3A is a side view of the beam adjustment assembly of FIG. 1 with the locking mechanism in the lock position, thereby preventing the rotation of the magnetic rings after adjustment.

In FIG. 1, a beam adjustment assembly 10 is mounted around a neck portion 12 of a cathode ray tube 14. The beam adjustment assembly is positioned between terminals 16 of the cathode ray tube 14 and a deflection yoke 18 also mounted around the neck portion 12.

In FIGS. 2A and 2C, a tubular portion 20 extends through the center of the beam adjustment assembly 10 from left to right. A clamp 22 and a clamp screw 24 provide for clamping of the tubular portion 20 to the neck portion 12 of the cathode ray tube 14 of FIG. 1. A first collar 26 in a plane substantially perpendicular to the axis of the tubular portion 20 is permanently affixed to the tubular portion 20. The collar 26 includes holes 28, 30 and 32 positioned approximately 120° apart, as shown in FIG. 2B. Also, the first collar 26 includes a first tab 34 and a second tab 36 as shown in FIG. 2B. These tabs are oriented at approximately 165° apart on the first collar 26. It should be understood that even though the tabs 34 and 36 are oriented approximately 165° apart in this embodiment, any angular orientation which provides the desired operation may be utilized.

A second collar 38 is retained on the left side of the tubular portion 20 in a plane substantially parallel to collar 26 by means of a finger 39 and two like fingers (not shown) which are a part of the tubular portion 20, are approximately 120° apart, and have hook portions. The hook portions of the finger 39 and the two like fingers provide for maintaining a relatively fixed dimension between a first surface 46 of the second collar 38 and a first surface 48 of the first collar 26. Fingers 40, 42 and 44 are a part of tubular portion 20 and contact the neck portion 12 as shown in FIG. 1 to hold the left side of the beam adjustment assembly in fixed relationship with the neck portion 12.

Magnet holding rings 50*a*, 50*b*, 52*a*, 52*b*, 54*a* and 54*b* are placed on the tubular portion 20. Magnet holding rings 50*b* and 52*a* are separated by a paper ring 56, indexed with the tubular portion 20, to provide for movement of ring 50*b* without affecting the adjustment of ring 52*a*. Also, magnets 52*b* and 54*a* are separated by a paper ring 58, indexed with the tubular portion 20, which provides for movement of ring 52*b* without affecting the adjustment of ring 54*a*. Paper rings 60 and 62, also indexed with the tubular portion 20, are placed between the ring 54*b* and a third collar 64 to provide for rotation of the third collar 64 without affecting the adjustment of the ring 54*b*. Although two paper rings 60 and 62 are used between ring 54*b* and collar 64 in this embodiment, any number of paper rings may be used in this location to compensate for dimensional variations in the components of beam adjustment assembly.

The third collar 64 has ramped surfaces 66, 68 and 70 located approximately 120° apart and extending from a surface 71 of the third collar 64 which is adjacent surface 48 of the first collar 26 as shown in FIG. 2A.

The third collar 64 also includes a first tab 72 which is oriented behind the first tab 34 of the first collar 26 as shown in FIG. 2B. Also the third collar 64 includes a second tab 74. Tabs 72 and 74 are oriented approximately 165° apart on the third collar 64. It should be understood, as mentioned in conjunction with first collar 26, that the angle between tabs 72 and 74 may be other than 165°. As will be noted by referring to FIG. 2B, the 165° angle between tabs 72 nd 74 is to the bottom side of FIG. 2B and the 165° angle between tabs 34 and 36 of first collar 26 is on the top side of FIG. 2B.

As can be noted by referring to the magnified view 76 of FIG. 2C, with the first tab 34 of the first collar 26 in line with the first tab 72 of the third collar 64, substantially all of the first surface 71 of the third collar 64 and all of the first surface 48 of the first collar 26 are in intimate contact. Under this condition, the magnet holding ring members 50*a*, 50*b*, 52*a*, 52*b*, 54*a* and 54*b* may be freely rotated with respect to the tubular portion 20 in order to obtain optimum adjustment of the magnet holding ring members with respect to the neck portion 12 of the kinescope 14 shown in FIG. 1.

Figure 3B:
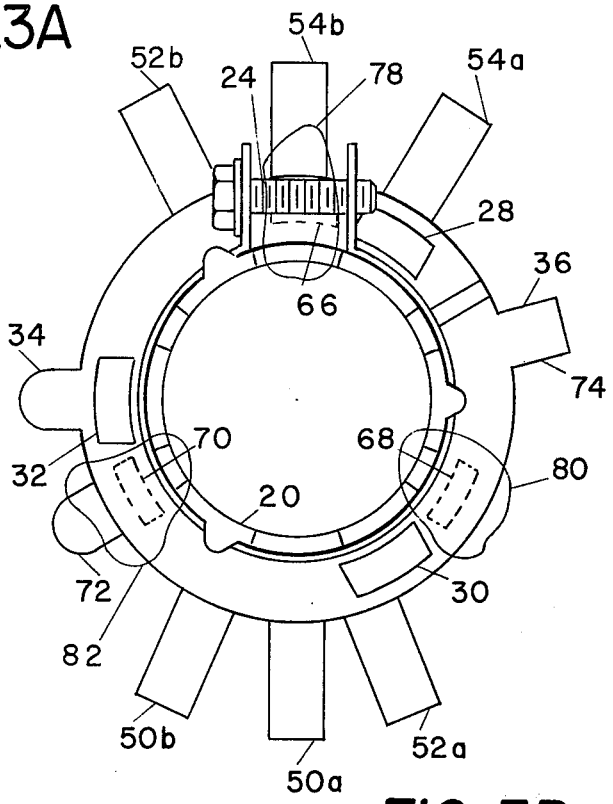
FIG. 3B is an end view of the beam adjustment assembly of FIG. 1 with the locking mechanism in the lock mode.
Figure 3C:
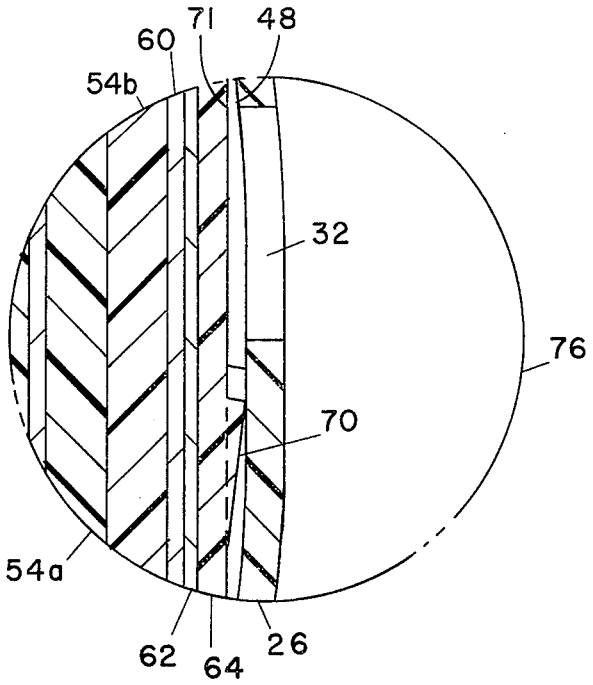
FIG.3C is an expanded view of a portion of FIG. 3A.

In FIGS. 3A, 3B and 3C, the second tab 36 of the first collar 26 is aligned with the second tab 74 of the third collar 64 by applying force to tabs 36 and 74 in directions to bring the tabs in an overlaying position. By applying forces in this manner, very little force is applied to the collar 26 relative to the neck portion 12 of the cathode ray tube 14. The paper rings 60 and 62 prevent rotation of magnet holding rings 54*a* and 54*b* when the aforementioned force is applied between the tabs. With the tabs oriented in this manner, the ramped surfaces 66, 68 and 70 of the third collar 64 are positioned out of the aperture holes 28, 30 and 32 of the first collar 26. With the ramped surfaces 66, 68 and 70 oriented as described above, pressure is applied between the third collar 64 and the second collar 38 due to the bending of the first collar 26 in zones 78, 80 and 82 shown in FIG. 3B. This pressure applied between third collar 64 and second collar 38 increases the frictional force between the second collar 38, magnet holding ring members 50*a*, 50*b*, 52*a*, 52*b*, 54*a* and 54*b*, paper rings 56, 58, 60 and 62, and third collar 64. This increased friction between the aforementioned components prevents movement of these components relative to the neck portion 12 of the kinescope 14 after adjustment under the conditions shown in FIGS. 2A ad 2B.

The above-described beam adjustment assembly provides for locking and unlocking of the magnet holding ring members of the beam adjustment assembly by applying force either between the first tab 34 of the first collar 26 and the first tab 72 of the third collar 64, or alternately, between the second tab 36 of the first collar 26 and the second tab 74 of the third collar 64. By applying force in this manner, no force need be applied between the beam adjustment assembly 10 and the neck portion 12 of the kinescope 14, but rather, the forces are applied only between the appropriate tabs. Therefore, the beam adjustment assembly described above prevents accidental rotation of the beam adjustment assembly relative to the neck portion 12 after optimum adjustment of the magnet holding ring members has been accomplished.

What is claimed is:

1. A beam adjustment assembly for a cathode ray tube comprising:

supporting means including a nonmagnetic supporting member having a central aperture for receiving the neck of said tube and a first resilient nonmagnetic collar having cam receiving means and first and second tabs and being in a plane substantially perpendicular to the axis of the neck of the tube; said supporting means further including captivating means for providing a surface substantially parallel to said first collar and substantially a first distance therefrom;

clamping means positioned on said supporting member for enabling the prevention of movement of said supporting member relative to said tube;

means positioned adjacent said supporting member and between said first collar and said capativating means and having a central aperture therein for receiving the neck of said tube, for providing a plurality of magnetic pole regions adjacent said central aperture thereof to produce magnetic fields in said central aperture; and a second nonmagnetic collar having a central aperture therein for receiving the neck of said tube, having camming means and third and fourth tabs, and being positioned between said first collar and said means positioned adjacent said supporting member and in a plane parallel with said first collar, said camming means of said third collar operating in conjunction with said cam receiving means of said first collar for enabling said captivating means and said third collar to provide first forces on said means positioned adjacent said supporting member when said first and third tabs are rotatably aligned and second forces on said means positioned adjacent said supporting member when said second and fourth tabs are rotatably aligned, thereby providing for control of the degree of restraint of the movement of said means postioned adjacent said supporting member relative to said supporting member by alternately applying forces to said first and third tabs and to said second and fourth tabs.

2. A beam adjustment assembly according to claim 1 wherein said captivating means comprises a third collar having a central aperture therein for receiving the neck of said tube, positioned on said supporting member in a plane substantially parallel to said first collar and providing a surface substantially said first distance from said first collar.

3. A beam adjustment assembly according to claim 2 wherein:

said camming means of said second collar includes a plurality of cam members extending from the surface of said third collar adjacent said first collar; and said cam receiving means of said supporting member includes a plurality of apertures in said first collar for receiving said cam members when said first and third tabs are rotatably aligned.

4. A beam adjustment assembly according to claim 3 wherein said cam members are ramps.

5. A beam adjustment assembly according to claim 4 wherein said first and second tabs and said third and fourth tabs are non-diametrically disposed and radially extending relative to said central aperture of said supporting member.

6. A beam adjustment assembly to claim 5 wherein said means positioned adjacent said supporting member includes magnet holding rings and nonmagnetic rings indexed with said supporting member and placed between said third collar and said magnet holding rings to prevent movement of said magnet holding rings when said third collar is moved relative to said first collar.

* * * * *